US011143396B2

(12) United States Patent
Wallace et al.

(10) Patent No.: US 11,143,396 B2
(45) Date of Patent: Oct. 12, 2021

(54) METHOD AND APPARATUS FOR WASTE HEAT RECOVERY AND EMISSION REDUCTION

(71) Applicant: Preferred Utilities Manufacturing Corporation, Danbury, CT (US)

(72) Inventors: Daniel P Wallace, Bethel, CT (US); Jianhui Hong, Buffalo Grove, IL (US); Charles A White, III, Danbury, CT (US); David G Bohn, Redding, CT (US)

(73) Assignee: Preferred Utilities Manufacturing Corp., Danbury, CT (US)

( * ) Notice: Subject to any disclaimer, the term of this patent is extended or adjusted under 35 U.S.C. 154(b) by 0 days.

(21) Appl. No.: 15/844,511

(22) Filed: Dec. 15, 2017

(65) Prior Publication Data

US 2019/0186730 A1 Jun. 20, 2019

(51) Int. Cl.

| | |
|---|---|
| ***F22B 35/00*** | (2006.01) |
| ***F23C 9/08*** | (2006.01) |
| ***F22B 35/10*** | (2006.01) |
| ***F22B 29/06*** | (2006.01) |
| ***F22B 13/00*** | (2006.01) |
| *F22B 7/12* | (2006.01) |

(52) U.S. Cl.

CPC ..... *F22B 35/002* (2013.01); *F22B 13/005* (2013.01); *F22B 29/06* (2013.01); *F22B 35/10* (2013.01); *F23C 9/08* (2013.01); *F22B 7/12* (2013.01)

(58) Field of Classification Search

CPC ..... F22B 13/005; F22B 29/06; F22B 35/10; F22B 7/12; F23C 9/08

USPC ..... 122/406.4

See application file for complete search history.

(56) References Cited

U.S. PATENT DOCUMENTS

| | | | | |
|---|---|---|---|---|
| 740,323 | A * | 9/1903 | Simms | |
| 4,162,686 | A * | 7/1979 | Infield | F22B 7/20 110/260 |
| 5,453,002 | A * | 9/1995 | Scott | F23N 5/02 431/42 |
| 2007/0199688 | A1* | 8/2007 | Okonski, Sr. | F22B 9/12 165/163 |
| 2012/0177553 | A1* | 7/2012 | Lindemann | F23J 7/00 423/239.1 |

FOREIGN PATENT DOCUMENTS

WO WO 82/01931 * 6/1982

* cited by examiner

*Primary Examiner* — Steven B McAllister
*Assistant Examiner* — Benjamin W Johnson
(74) *Attorney, Agent, or Firm* — Jianhai Hoag

(57) ABSTRACT

The current invention discloses a method and apparatus for production of hot water or steam in a 4-pass firetube boiler. A waste heat stream is passed through the first and second passes of the boiler, and then routed into a furnace tube (which is the third pass of the boiler) to help suppress the flame temperature and NOx emissions from the burner. The flue gas from the third pass is then passed through the fourth pass of the boiler to transfer the heat energy to the water in the boiler.

14 Claims, 5 Drawing Sheets

METHOD AND APPARATUS FOR WASTE HEAT RECOVERY AND EMISSION REDUCTION

BACKGROUND OF THE INVENTION

1. Field of the Invention

This invention relates generally to a firetube boiler and a burner system for the production of hot water or steam. More particularly, this invention relates to a firetube boiler and a burner system that takes a waste heat stream and recovers a portion of the heat energy from the waste heat stream, and reduces the emissions from the waste heat stream and the burner system.

2. Description of the Related Art

Boilers are widely used for the generation of hot water and steam. A conventional boiler (excluding Heat Recovery Steam Generator or HRSG) comprises a furnace in which fuel is burned, and surfaces typically in the form of steel tubes to transfer heat from the flue gas to the water. A conventional boiler has a furnace that burns a fossil fuel or, in some installations, waste fuels or biomass derived fuels. According to the website of Britannica, the first boiler with a safety valve was designed by Denis Papin of France in 1679; boilers were made and used in England by the turn of the 18th century. Most conventional boilers are classified as either firetube boilers or watertube boilers. In a firetube boiler, the water surrounds the steel tubes through which hot flue gases from the furnace flow. In a watertube boiler, the water is inside the tubes with the hot flue gases flowing outside the tubes. One example of firetube boilers is Scotch Marine firetube boilers. There have been relatively few innovations in the designs of firetube boilers in the last few decades. Several incremental improvements aimed to enhance the heat transfer efficiency of the firetube boilers. The introduction of helical ribs inside the firetubes (also known as "spiral tubes" or "gun barrel tubes") and spiral turbulators inserted inside the tubes, are a couple of examples of such incremental improvements. The recent innovations have been focused on low NOx and ultra low NOx burner technologies. However, innovations in the low emission burners have been hampered by the lack of innovations in the firetube boilers. In order for low emission burner technologies to make further progress, there exists a need for a holistic approach, to treat the firetube boiler and the burner as an integral system, rather than two separate and loosely related sub-systems.

NOx is a recognized air pollutant. Regulations on NOx tend to get more stringent in densely populated areas of the world. In some areas, local regulations require low NOx or even ultra low NOx emissions in the exhaust from the combustion processes of the boilers. Various low NOx and ultra low NOx burners are available in the market to meet these requirements. A review of typical NOx reduction methods can be found in the article "NOx emissions: Reduction Strategy" in "Today's Boiler" magazine Spring 2015 by Jianhui Hong. FGR (Flue gas recirculation) is a commonly used technique for NOx reduction. In one approach called "forced FGR", FGR is added into the burner system downstream of the combustion air blower with the help of a separate FGR blower. Flue gas is pulled from the stack and pushed through some sort of manifold or bustle ring into the flame. The forced FGR approach is more energy efficient in terms of electrical consumption for the combustion air blower. However it often requires a factory modified burner capable of forced FGR. From a control standpoint, the forced FGR cannot be substantially self-controlled like induced FGR. The addition of a separate FGR blower demands accurate and reliable control of the rate of FGR relative to the rate of combustion air, making the control more complicated.

In another approach called "Induced FGR", flue gas is drawn through a duct to the inlet of the air blower and mixed with the combustion air by using the blower wheel as a mixing device. The flue gas is typically at a higher temperature than the ambient air. The introduction of flue gas into the blower can sometimes lead to condensation, corrosion, and heat damage to some burner equipment. For example, condensation on the spark ignition system could render it inoperable due to electric short-circuit. Corrosion to the internal parts of the blower and the burner head can occur due to condensation. Heat and condensation from the flue gas can damage or interfere with the flame scanner, which is a part of the burner management system. The heat can also transmit through the shaft of the electric motor and damage the motor if the shaft is not properly cooled.

According to the Perry's Chemical Engineers' Handbook ($7^{th}$ Edition) Section 10-46, the horsepower requirement for a blower is determined by the multiplication of two factors, the volumetric flow rate through the blower in cubic feet per minute, and the blower operating pressure in inches water column. Induced FGR increases both the volumetric flow rate through the blower and the pressure drop through the burner and the boiler (hence increasing the blower operating pressure required), and therefore greatly increases the horsepower requirement for the blower motor. In this sense, induced FGR penalizes the blower horsepower requirement twice, once for the extra volumetric flow rate, and another for the extra pressure drop through the boiler and burner system.

Waste Heat Recovery Boilers (WHRB) are commercially available in the market. Just as boilers in general, they come in two types: watertube type and firetube type. These waste heat recovery boilers often do not include a burner. If the flow rate or temperature of the waste heat source is reduced due to process variation of the waste heat source, the WHRB may not be able to generate the hot water or steam to meet the desired heat load. There exists a need for a WHRB to fire a standby burner when the additional heat load is needed.

The waste heat source is any gaseous stream with recoverable energy. The waste heat source could be a hot flue gas stream from a gasoline/diesel power generator, a gas turbine power generator, a Stirling engine, or in fact a hot flue gas from any combustion process. The waste heat source could be a waste stream with undesired air pollutants such as hydrocarbons, CO, and NOx. Passing the waste heat source through the flame of a burner would serve two purposes: the first is the destruction of the air pollutants such as CO and hydrocarbons leading to reduction of emissions of these pollutants; the second is reduction of NOx emission from the burner since the waste heat source tends to function to reduce the peak flame temperature and NOx emission from the flame of the burner, similar to how FGR is used to reduce NOx.

In view of the foregoing, there exists a need for an improved method and apparatus for a firetube boiler and a burner system that takes a waste heat source and recovers a portion of the heat energy from the waste heat source, and reduces the emissions from the waste heat source and the burner system.

SUMMARY OF THE INVENTION

It is a general object of the present invention to provide a method and apparatus for a firetube boiler and a burner system that takes a waste heat stream and recovers a portion of the heat energy from the waste heat stream, and reduces the emissions from the waste heat stream and the burner system.

This object is achieved by a method of producing hot water or steam in a four-pass firetube boiler, comprising the steps of, producing a waste heat stream in a combustion process separate and independent of said boiler; passing a first portion of said waste heat stream through a first and second passes of firetubes of said boiler to recovery heat energy; supplying a fuel and a combustion air stream to a burner to produce a flame in a furnace tube of said boiler, said furnace tube forming the third pass of said boiler; routing said first portion of said waste heat stream to said burner to reduce flame temperature and NOx emissions from said flame; producing a flue gas from said flame in said furnace tube; passing said flue gas through a fourth pass of said boiler, wherein said fourth pass comprises a plurality of firetubes; routing said flue gas to the exhaust outlet of said boiler.

This object is achieved by an apparatus for producing hot water or steam, said apparatus comprising: a 4-pass firetube boiler comprising a shell substantially cylindrical in shape, having a front end and a back end; a front tube sheet and at least one back tube sheet; a furnace tube and a plurality of firetubes positioned inside the shell and substantially extending the length of the shell from the front end to the back end, said furnace tube forms a third pass, said firetubes form a first and second passes and a fourth pass in said boiler, wherein said first pass comprises a firetube and allows a first portion of a waste heat stream to flow in the direction from the front end to the back end; said second pass comprises a plurality of firetubes and allows said first portion of said waste heat stream to flow in the direction from the back end to the front end; said third pass allows a flue gas to be produced within and to flow in the direction from the front end to the back end; and said fourth pass comprises a plurality of firetubes and allows said flue gas to flow in the direction from the back end to the front end; water in a lower part of a void space defined within the boundaries of said shell, said front and back tube sheets, said furnace tube and firetubes up to a desired water level, leaving an upper part of said void space for collecting water vapor or steam; and a burner affixed to the front end of said boiler producing a flame in said furnace tube, comprising a supply of fuel with means of flow control and safety shutoff; a supply of combustion air with means of flow control;

means for ignition; means for detecting the presence of said flame; wherein said first portion of said waste heat stream passes through said first and second passes of said boiler to transfer heat energy to the water in said boiler, and is then routed to said burner to reduce temperature of said flame and to reduce NOx emissions from said flue gas.

Additional objects and features of the invention will appear from the following description from which the preferred embodiments are set forth in detail in conjunction with the accompanying drawings.

BRIEF DESCRIPTION OF THE DRAWINGS

Identical reference numerals throughout the figures identify common elements.

DESCRIPTION OF THE PREFERRED EMBODIMENTS

Figure 1:
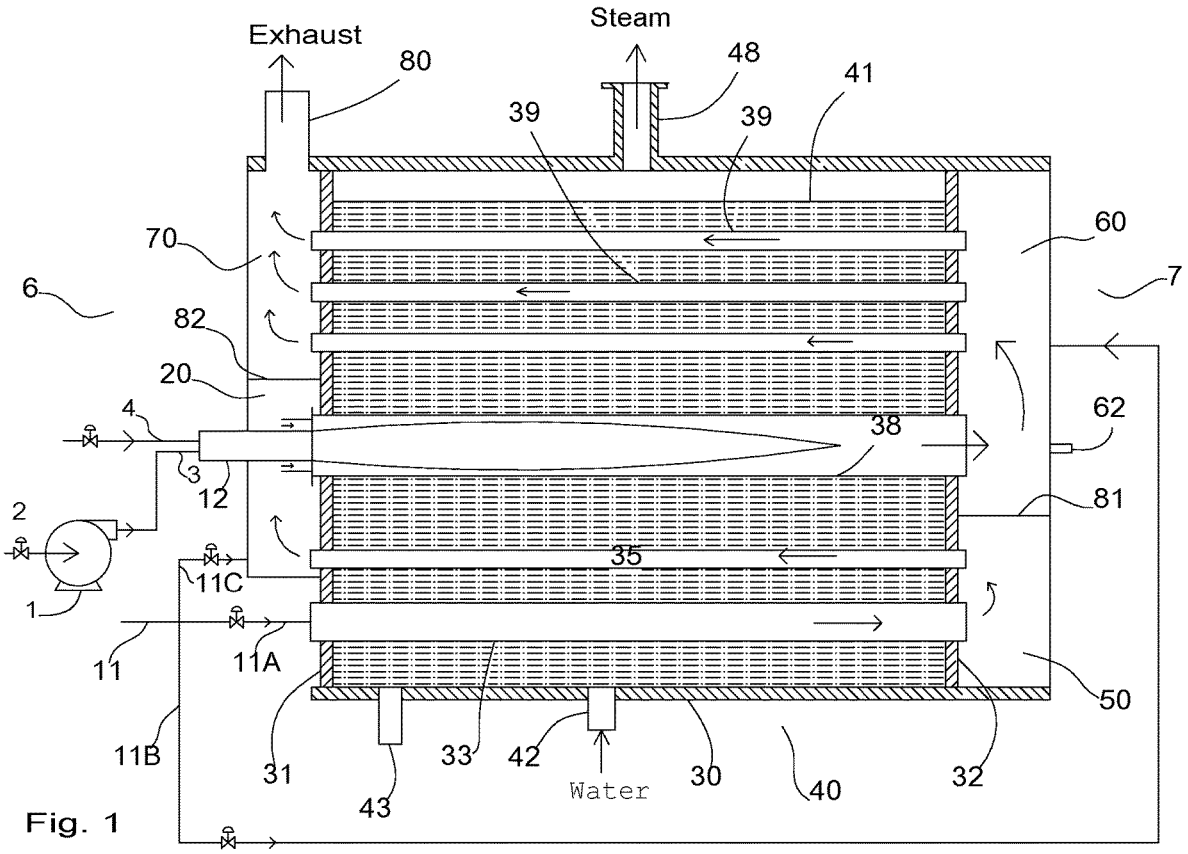
FIG. 1 is a schematic view of an apparatus for producing steam in accordance with the present invention.

FIG. 1 shows a schematic view of an apparatus for the current invention. A boiler 5 has a cylindrical shell 30, which is welded to a front tube sheet 31 and a rear tube sheet 32 to form a pressure vessel 40. Large firetube 33 and furnace tube 38 are positioned in the shell 30 to extend the length of the shell from tube sheet 31 and to tube sheet 32, and sealingly attached to these tube sheets per firetube boiler codes. A plurality of firetubes 35 and 39 are also positioned in the shell 30 to extend the length of the shell from tube sheet 31 to tube sheet 32. These firetubes 35 and 39 are sealingly attached to these tube sheets per firetube boiler codes.

The boiler 5 has a front end 6 in the vicinity of tube sheet 31, and a back end 7 in the vicinity of tube sheet 32. Feed water is supplied into the boiler through water inlet 42. When necessary, water can be drained through drain outlet 43. Steam is collected in the vapor space within the pressure vessel 40 and above the water level 41, and discharged through steam outlet 48 when steam pressure exceeds a desired pressure setpoint.

A burner 10 has a combustion head 12. Burner 10 comprises means for supplying a fuel and combustion air in a proper air/fuel ratio so that combustion can be sustained, a burner management system (BMS), a means of ignition, and a means for flame monitoring to ensure safety. For clarity and simplicity of illustration, some details of burner 10 are omitted in FIG. 1. The combustion air to the burner is supplied by a blower 1 and regulated by an inlet air duct 2. The fuel supplied to the burner is through fuel line 4. For simplicity, the pressure regulator and safety shutoff valves for the fuel are not shown. Means for flame monitoring may include but are not are limited to UV scanner, IR scanner and flame rod.

A waste heat stream 11 is fed into large firetube 33 through line 11A. Large firetube 33 is also called the first pass. The waste heat stream flows in the first pass in the direction from the front end 6 to the back end 7, then exits from the first pass into a chamber 50 affixed to the back end 7. The waste heat stream then goes through a plurality of firetubes 35 (only one firetube 35 shown in FIG. 1, but this figure is for illustrating the concept only; see FIGS. 2 and 3 for realistic arrangements showing multiple firetubes 35), which are referred to as the second pass of the boiler, in the direction from the back end 7 to the front end 6, and discharges into the lower section of a chamber 20 affixed to the front end 6. The waste heat stream then flows to the upper section of chamber 20. The burner head 12 of the burner 10 is disposed in the upper section of chamber 20 to produce a flame in furnace tube 38. The waste heat stream in chamber 20 is injected into the flame of burner 10, typically around the outside perimeter of the burner head 12, to reduce the peak flame temperature, and thus reduce NOx emissions from burner 10. The waste heat stream is used to suppress the NOx emissions of burner 10, in a manner very similar to "forced FGR", except that the waste heat stream comes from a source separate and independent of burner 10, and hence the current invention does not involve recirculation of the flue gas from the burner.

The waste heat stream goes through the first and second passes, and a portion of the heat energy in the waste heat stream has been recovered by transferring to the water in the boiler to produce steam. In this process the waste heat stream is cooled down to a lower temperature, making it more effective in cooling down the peak flame temperature and in reducing NOx emissions from burner 10. The disclosed invention not only recovers heat energy from the waste heat stream, but also reduces NOx emissions from the burner 10. In addition, if there are high levels of air pollutants such as CO, VOC and hydrocarbons in the waste heat stream, these air pollutants can be destroyed or consumed (partially or entirely) by the flame of burner 10. It can be seen that the current invention is highly useful, in both economic and environmental terms.

The burner 10 produces a flue gas in furnace tube 38, which is referred to as the third pass of the boiler. The flue gas exits the third pass and discharges into a chamber 60 affixed to the back end 7, enters and goes through a plurality of firetubes 39, which are collectively called the fourth pass of the boiler.

The flue gas exits the fourth pass, and discharges into a flue gas collection chamber 70 affixed to the front end 6, and is vented out of the boiler through flue gas outlet 80. The rear chambers 60 and 50 are separated by a divider 81, and otherwise form a single smokebox surrounded by shell 30 and a smokebox back cover (not shown in FIG. 1). The chambers 20 and 70 are separated by a divider 82.

The burner 10 is mounted to the front end 6, with the burner head 12 disposed in chamber 20. The observation port 62 is located at the back end 7. Port 62 allows manual observation of the flames in furnace tube 38. For simplicity, insulation and refractory materials commonly used for boilers are not shown in any figures in this invention. The removeable doors or covers for the chambers 20, 50, 60 and 70 are also omitted.

It is well known that burners can be classified as premixed type or diffusion type (also known as non-premixed type), depending on whether the fuel and air is mixed well before combustion is initiated. Burner 10 in FIG. 1 can be either a premixed type or a diffusion type. High levels of CO, VOC, hydrocarbons, and oxygen in the waste heat stream can be destroyed or consumed by the flame of the burner 10. The waste heat stream in turn helps suppress the peak flame temperature of burner 10, and reduces the emissions of NOx.

In a particular embodiment, a blower 1 supplies combustion air to burner 10. Combustion air is drawn in from inlet air duct 2 by the blower 1, goes through air duct 3 to the burner head 12. A fuel, such as natural gas, propane or fuel oil, is supplied from a source (not shown) through fuel lines 4 to burner head 12. The fuel flows through fuel line 4 are modulated by modulation valves and can be shut off by safety shutoff valves (not shown). Combustion air flow through air duct 3 is modulated by a damper and a variable frequency drive (not shown) on the motor of the blower. One air damper is shown in the inlet air duct 2, controlling the amount of combustion air supplied to burner head 12. Burner 10 is equipped with means for ignition and flame monitoring systems (not shown).

There is an upper limit on how much waste heat stream the burner 10 can take before the burner becomes unstable. In order to use the waste heat stream 11 to suppress the NOx formation from the burner 10 without extinguishing or de-stabilizing the flame, there is an optimum ratio of the waste heat stream 11 to the firing rate of burner 10. This ratio can be expressed as the mass flow rate of waste heat stream to the mass flow rate of combustion air to the burner 10. The optimum ratio depends on the compositions, the temperature of the waste heat stream, and the type of fuel gas being burned. In general, the mass flow rate of the waste heat stream is 5-40% of the mass flow rate of the combustion air to burner 10 in order to achieve emission reduction for the burner flame. The mass flow rate of the waste heat stream is 15-25% of the mass flow rate of the combustion air to burner 10 in order to achieve the best emission performance for the burner flame. In general, if the waste heat stream has a higher temperature, the burner can take more of it (up to 40%) without becoming unstable; and if the waste heat stream has a lower temperature, the burner can take less of it without becoming unstable. In general, if the waste heat stream has a higher oxygen content, the burner can take more of it (up to 40%) without becoming unstable; and if the waste heat stream has a lower oxygen content, the burner can take less of it without becoming unstable. In general, the burner should be operated with 1-3% oxygen in the flue gas leaving the third pass on dry volume basis to maximize the thermal efficiency of the burner.

In operation, it is possible that the mass flow rate of the waste heat stream is more than the burner 10 can take in terms of flame stability and emission performance. In the case, at least a portion (up to 100%) of the waste heat stream is sent through line 11B to chamber 60 (see FIG. 1), and goes directly into the fourth pass, thus bypassing the first, second and third passes.

In operation, it is possible that it takes too much pressure drop for the waste heat stream to pass through the first and second passes due to the limited flow capacity of these stages, or that passing through the first and second passes would cause condensation in the fire tubes 33 and 35. Under these conditions, it is desirable to bypass the first and second passes. In these cases, the waste heat stream is sent through line 11C into chamber 20.

Figure 2:
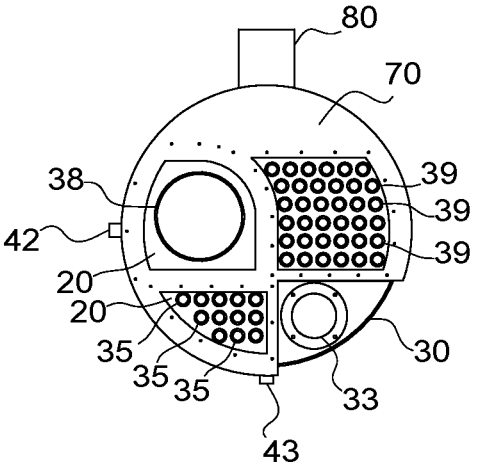
FIG. 2 is a front view of an embodiment of the firetube boiler with front covers removed.
Figure 3:
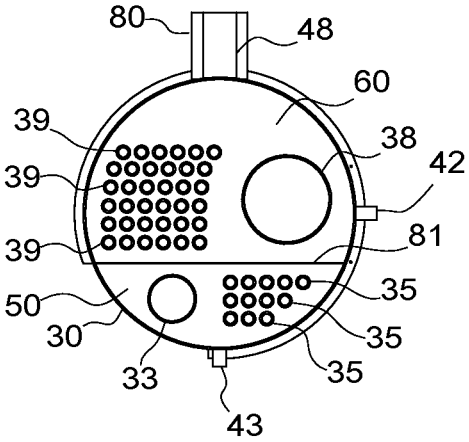
FIG. 3 is a rear view of the same boiler in FIG. 2, with rear cover removed.

FIGS. 2 and 3 show the front and rear views of an embodiment of the firetube boiler according to the current invention. The four passes are generally divided into four quadrants. FIG. 3 shows how the divider 81 separated a rear smokebox into two chambers 50 and 60. A refractory insulated backcover (not shown), as is commonly seen in firetube boilers, when installed, should seal tightly against this divider 81, to prevent the waste heat stream from the chamber 50 to go directly to chamber 60, bypassing the second pass. Alternatively, chambers 50 and 60 can be sealed off using two separate refractory-insulated back covers (not shown).

Figure 4:
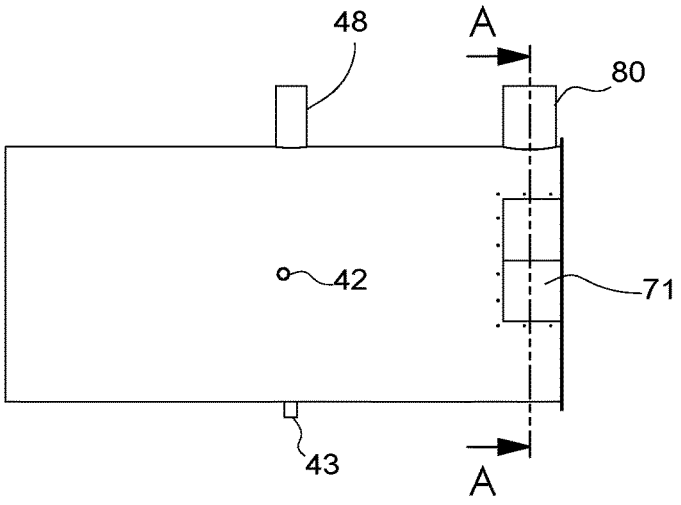
FIG. 4 is a side view of the same boiler in FIG. 2 without the front and rear covers.

FIG. 4 shows a side view of the boiler in FIG. 2. Note the side opening 71 is for easy access to the burner head 12. The removeable cover for the side opening 71 is not shown in FIGS. 4 and 5.

Figure 5:
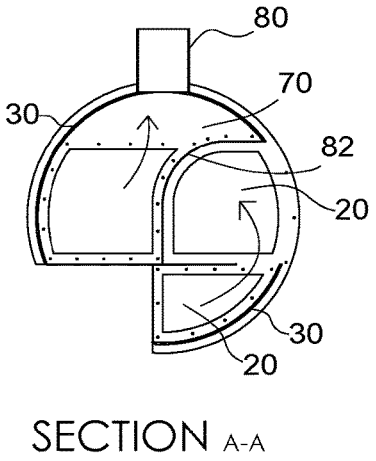
FIG. 5 is section view along section line A-A.

FIG. 5 shows a section view along section line A-A in FIG. 4. It shows the waste heat stream moving from the lower section of the front chamber 20 to the upper section of front chamber 20. The upper and lower sections of chamber 20 are fluidically communicating with each other. They can be partially divided, to guide the flow pattern of the waste heat stream. It also shows the flue gas flows in chamber 70 to the exhaust stack 80. The divider 82 separates chamber 20 from chamber 70.

Figure 6:
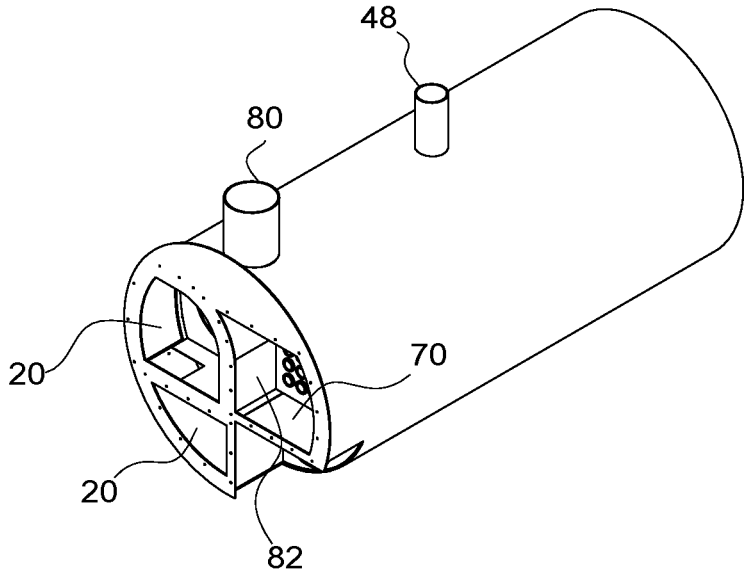
FIG. 6 is a perspective view of the same boiler in FIG. 2.

FIG. 6 shows a perspective view of the boiler in FIG. 2. Looking at the front end of the boiler, the lower right quadrant is the inlet of the first pass; the lower left quadrant is the outlet of the second pass discharging into the lower section of chamber 20; the upper left quadrant is the upper section of chamber 20, which leads to the inlet of the third pass, and is fluidically communicating to the lower section of chamber 20; the upper right quadrant is the outlet of the fourth pass discharging into chamber 70, which is fluidically communicating to the exhaust stack 80.

Figure 7:
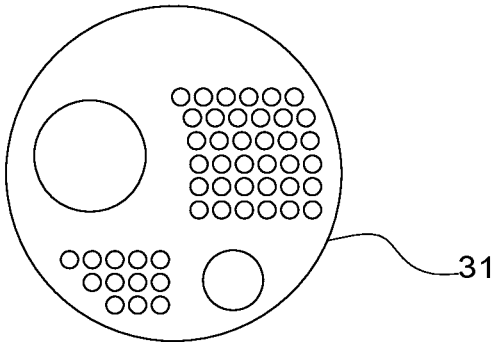
FIG. 7 is a front view of the tube sheet 31 or 32.

FIG. 7 shows a front view of the tube sheets 31 or 32. Tube sheets 31 and 32 are identical in dimensions and are aligned with each other in the axial directions of the round openings.

Some common elements such as handholes and ports for water level control were omitted in these figures for clarity of illustration.

The third (furnace tube 38) and fourth passes (firetubes 39) of the boiler in FIG. 1, correspond to the first and second passes of a two-pass boiler. The third and fourth passes can arguably be referred by anyone skilled in the art as the first and second passes associated with the burner 10, since fuel and air from the burner 10 is indeed making a first and second passes through the boiler. However, during normal operation, the waste heat stream has already made two passes (fire tube 33 and firetubes 35) through the boiler when they go through furnace tube 38 and firetubes 39, and therefore the waste heat stream is making a third and fourth passes through the boiler. Calling furnace tube 38 and firetubes 39 as first and second passes for the burner 10 of the burner by anyone skilled in the art is simply a choice of nomenclature, and does not create a new invention outside the scope of this invention, and therefore is still covered within this invention.

It is common in the firetube boiler industries to have dry back and wet back designs. FIG. 1 shows a dry back design. But a wet back design could be easily implemented for the current invention by anyone skilled in the art, after reviewing the current disclosure.

As is well understood in the boiler industry, if hot water production is desired instead of steam, steam outlet 48 in FIG. 1 would be replaced by a hot water outlet located at a proper location on the shell 30.

The foregoing description, for purposes of explanation, used specific nomenclature to provide a thorough understanding of the invention. However, it will be apparent to one skilled in the art that the specific details are not required in order to practice the invention. In other instances, well known devices are shown in block diagram form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed. Obviously many modifications and variations are possible in view of the above teachings. The embodiments were chosen and described in order to best explain the principles of the invention and its practical applications, the thereby enable others skilled in the art to best utilize the invention and various embodiments with various modifications as are suited to the particular use contemplated. It is intended that the scope of the invention be defined by the following claims and their equivalents.

What is claimed is:

1. A method of producing hot water or steam in a four-pass firetube boiler, comprising the steps of, a) producing a waste heat stream in a combustion process separate and independent of said boiler;

b) passing a first portion of said waste heat stream at a first flow rate through a first pass and a second pass of firetubes of said boiler to recover heat energy;

c) supplying a fuel stream at a fuel flow rate and a combustion air stream that is distinct from the waste heat stream at a combustion air flow rate at an air/fuel ratio that is capable of sustaining a flame to a burner to produce said flame in a furnace tube of said boiler, said furnace tube forming a third pass of said boiler;

d) monitoring said flame using a flame detector;

e) routing said first portion of said waste heat stream to said burner to reduce flame temperature and NOx emissions from said flame;

f) producing a flue gas from said flame in said furnace tube;

g) passing said flue gas through a fourth pass of said boiler, wherein said fourth pass comprises a plurality of firetubes;

h) routing said flue gas to an exhaust outlet of said boiler.

2. The method as described in claim 1, further comprising a step of routing a second portion of said waste heat stream directly to the fourth pass of said boiler, bypassing the first, second and third passes in order to avoid de-stabilizing said burner.

3. The method as described in claim 1, further comprising a step of routing a third portion of said waste heat stream directly to the third pass of said boiler, bypassing the first and second passes.

4. The method as described in claim 1 wherein said burner is a premixed combustion type burner.

5. The method as described in claim 1 wherein said burner is a diffusion combustion type burner.

6. The method as described in claim 1 wherein said first portion of said waste heat stream is injected around an outside perimeter of said flame produced by said burner.

7. The method as described in claim 1 wherein the first flow rate of said first portion of said waste heat stream is 5% to 40% (by mass) of the rate of combustion air supplied to said burner.

8. An apparatus for producing hot water or steam, said apparatus comprising 1) a 4-pass firetube boiler comprising 1a) a shell substantially cylindrical in shape, having a front end and a back end;

1b) a front tube sheet and at least one back tube sheet;

1c) a furnace tube and a plurality of firetubes positioned inside the shell and substantially extending from the front end to the back end, said furnace tube forms a third pass, said firetubes form a first pass and a second pass and a fourth pass in said boiler, wherein said first pass comprises a firetube and allows a first portion of a waste heat stream to flow in a direction from the front end to the back end; said second pass comprises a plurality of firetubes and allows said first portion of said waste heat stream to flow in a direction from the back end to the front end; said third pass allows a flue gas to be produced within and to flow in the direction from the front end to the back end; and said fourth pass comprises a plurality of firetubes and allows said flue gas to flow in the direction from the back end to the front end;

1d) water in a lower part of a void space defined within said shell, said front and back tube sheets, said furnace tube and firetubes up to a water level above said furnace tube and firetubes, leaving an upper part of said void space for collecting water vapor or steam;

2) a burner affixed to the front end of said boiler producing a flame in said furnace tube, comprising 2a) a supply of fuel with a flow control valve and a safety shutoff valve;

2b) a supply of combustion air with a Variable Frequency Drive or a louver for flow control;

2c) an ignitor; and 2d) a flame detector;

wherein said first portion of said waste heat stream passes through said first and second passes of said boiler to transfer heat energy to the water in said boiler, and is then routed to said burner to reduce temperature of said flame and to reduce NOx emissions from said flue gas.

9. The apparatus as described in claim 8 wherein a second portion of said waste heat stream is routed directly to the fourth pass of said boiler, bypassing the first, second and third passes of said boiler.

10. The apparatus as described in claim 9 wherein a third portion of said waste heat stream is routed directly to the third pass of said boiler, bypassing the first and second passes of said boiler.

11. The apparatus as described in claim 8 wherein the burner is a premixed type burner.

12. The apparatus as described in claim 8 wherein the burner is a diffusion type burner.

13. The apparatus as described in claim 8 wherein said boiler is a dry back design.

14. The apparatus as described in claim 8 wherein said boiler is a wet back design.

* * * * *